US011715898B2

(12) United States Patent
Niitsu et al.

(10) Patent No.: US 11,715,898 B2
(45) Date of Patent: Aug. 1, 2023

(54) HIGHLY RELIABLE TERMINAL AND CONNECTOR WITH A COMPACT LOW PROFILE

(71) Applicant: Molex, LLC, Lisle, IL (US)

(72) Inventors: Toshihiro Niitsu, Yamato (JP); Akihiro Shimotsu, Ebina (JP); Yoshiteru Nogawa, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 17/391,359

(22) Filed: Aug. 2, 2021

(65) Prior Publication Data

US 2022/0069500 A1 Mar. 3, 2022

Related U.S. Application Data

(60) Provisional application No. 63/072,733, filed on Aug. 31, 2020.

(30) Foreign Application Priority Data

Jan. 12, 2021 (JP) ..... 2021-002936

(51) Int. Cl.
*H01R 13/11* (2006.01)
*H01R 12/71* (2011.01)
*H01R 12/57* (2011.01)

(52) U.S. Cl.
CPC ..... *H01R 13/111* (2013.01); *H01R 12/57* (2013.01); *H01R 12/718* (2013.01)

(58) Field of Classification Search
CPC .... H01R 13/111; H01R 12/57; H01R 12/718; H01R 12/91; H01R 13/2414; H01R 13/62
See application file for complete search history.

(56) References Cited

U.S. PATENT DOCUMENTS 4,381,130 A * 4/1983 Sprenkle ..... H01R 13/193 439/268
4,422,703 A * 12/1983 Christensen ..... H01R 12/88 439/55
7,137,841 B1 * 11/2006 Liao ..... H05K 7/1084 439/857
7,402,066 B2 * 7/2008 Liao ..... H05K 7/1084 439/857

(Continued)

FOREIGN PATENT DOCUMENTS

JP 2001135436 A 5/2001
JP 2013065459 A 4/2013

(Continued)

*Primary Examiner* — Travis S Chambers

(57) ABSTRACT

Problem: To realize a connection with a counterpart connector with high spacing efficiency, and to stably maintain an electrically connected state while having a compact and low profile and without the terminal being deformed or damaged, even when subjected to a force from a counterpart terminal when mated with the counterpart terminal, which increases reliability. Solution: The terminal includes a substrate fixing part 52 fixed to a substrate 11, a pair of contact parts which sandwich a counterpart terminal 151, and an elastic deformation part having both ends connected to the substrate fixing part 52 and the contact parts, respectively, wherein a spring constant of the elastic deformation part is smaller than a spring constant of the contact parts.

5 Claims, 12 Drawing Sheets

(56) References Cited

U.S. PATENT DOCUMENTS

| | | | | |
|---|---|---|---|---|
| 7,553,176 | B2 * | 6/2009 | Naito | H01R 33/7642 439/239 |
| 7,654,874 | B2 * | 2/2010 | Ader | H01R 12/58 439/853 |
| 8,758,068 | B2 * | 6/2014 | Wang | H01R 4/02 439/816 |
| 9,278,224 | B1 * | 3/2016 | Vadlamudi | H01R 13/187 |
| 9,634,413 | B2 * | 4/2017 | Hashiguchi | H01R 13/113 |
| 2011/0034052 | A1 * | 2/2011 | Yeh | H01R 13/193 439/259 |
| 2012/0003846 | A1 * | 1/2012 | Wertz | H01R 12/718 439/65 |
| 2016/0064810 | A1 * | 3/2016 | Smith | H01Q 1/243 439/862 |

FOREIGN PATENT DOCUMENTS

| | | | |
|---|---|---|---|
| JP | 2013114950 | A | 6/2013 |
| JP | 2014010966 | A | 1/2014 |
| JP | 2014044821 | A | 3/2014 |

* cited by examiner

Prior art

HIGHLY RELIABLE TERMINAL AND CONNECTOR WITH A COMPACT LOW PROFILE

RELATED APPLICATIONS

The present application claims priority to Japanese Patent Application No. 2021-002936 filed on Jan. 12, 2021 which claims priority to U.S. Patent Application No. 63/072,733 filed Aug. 31, 2020, both of which are incorporated by reference in their entireties.

TECHNICAL FIELD

The present disclosure relates to a terminal and a connector.

BACKGROUND ART

Conventionally, when a semiconductor device such as an LSI or a CPU provided with PGA (Pin Grid Array) type terminals is connected to a circuit board such as a printed wiring board, the terminals thereof are electrically connected to the conductive traces of the circuit board via a connector called a socket attached to the circuit board. The socket is provided with a housing in which a plurality of openings corresponding to each of the pin-shaped terminals of the semiconductor device are formed, and a plurality of terminals housed in each opening so as to engage with each of the pin-shaped terminals (for example, see Patent Document 1).

FIG. 9 is a perspective view illustrating a terminal of a conventional connector.

In the drawing, 851 is a terminal housed within each of a plurality of openings formed in a housing of a connector mounted on a circuit board (not illustrated), and is fabricated by performing a process such as punching or bending on a metal plate.

The terminal 851 has a flat plate-shaped support part 852, a bent coupling part 853 connected to an upper end of the support part 852, and an engagement part 854 connected to a tip of the coupling part 853. Note that the support part 852 includes a branched part 852*a* that branches toward the side.

In addition, the engagement part 854 is a substantially U-shaped portion including a first side part 854*a* having an upper end connected to a tip of the coupling part 853, a bottom part 854*b* connected to a lower end of the first side part 854*a*, and a second side part 854*c* having a lower end connected to the bottom part 854*b*. Note that the first side part 854*a* and the second side part 854*c* are formed so as to gradually approach one another toward the open end 854*d* formed at the upper end of the engagement part 854. Further, the width W of the open end 854*d* is smaller than the diameter of the pin-shaped terminal (not illustrated) with which the terminal 851 engages, and is set so as to be pushed out by the pin-shaped terminal. A guide piece 854*e* which guides the pin-shaped terminal is connected to a portion of the first side part 854*a* and the second side part 854*c* corresponding to the open end 854*d*.

When the terminal 851 is housed in each opening formed in the housing, a lower end of the support part 852 and the branched part 852*a* is inserted into a through-hole penetrating through the bottom surface of the opening to reach the bottom surface of the housing, which causes the terminal 851 to be fixed to the housing. In addition, a lower end of the branched part 852*a* is electrically connected by soldering to a connection pad on a surface of the circuit board on which the housing is mounted. Further, a side surface of the support part 852 on the opposite side as the engagement part 854 abuts an inner wall surface of the opening. Therefore, even if the engagement part 854 is subjected to a force when the pin-shaped terminal is inserted into the open end 854*d*, such a force is received by the inner wall surface of the opening, so each part of the terminal 851 is not deformed or damaged.

Prior Art Documents; Patent Documents; Patent Document 1: Japanese Unexamined Patent Application Publication No. 2001-135436 A

SUMMARY

Technical Problem

However, the conventional connector described above cannot sufficiently handle the reduction in size of components in recent electronic devices. In mobile communication devices such as smart phones or electronic devices such as laptop computers, tablets, digital cameras, music players, game machines, and navigation devices, a compact and low-profile housing and accompanying compact and low-profile components are required, but the conventional connector described above cannot sufficiently meet the demand for a compact and low-profile connector because the dimensions of the housing in which a plurality of openings for housing the terminals 851 are formed are large.

However, it is also conceivable to reduce the size and lower the profile of the conventional connector described above by omitting the housing. However, in this case, the terminal 851 will only be supported by the lower end of the branched part 852*a* being soldered to the connection pad on the surface of the circuit board, so when the pin-shaped terminal is inserted into the open end 854*d* so that the engagement part 854 is subjected to a force, such a force may deform or damage each portion of the terminal 851, or may break the soldered portion between the lower end of the branched part 852*a* and the connection pad on the surface of the circuit board.

Here, an object of the present invention is to resolve the problems of the conventional connector described above, and to provide a highly reliable terminal and a connector capable of realizing a connection with a counterpart connector with high spacing efficiency and capable of stably maintaining an electrically connected state while having a compact and low profile and without being deformed or damaged, even when subjected to a force from a counterpart terminal when mated with the counterpart terminal.

Solution to Problem

Therefore, the terminal includes a substrate fixing part fixed to the substrate, a pair of contact parts which sandwich the counterpart terminal, and an elastic deformation part having both ends connected to the substrate fixing part and the contact parts, respectively, wherein a spring constant of the elastic deformation part is smaller than a spring constant of the contact parts.

In another terminal, the elastic deformation part further includes a thin part having a smaller plate thickness than the substrate fixing part and the contact parts.

In yet another terminal, each contact part further includes a base part connected to an upper end of the elastic deformation part and extending parallel to the substrate fixing part, and a contact arm extending downward from a bottom surface of the base part, wherein each contact arm includes an inclined part which is inclined so as to approach the other contact arm in a downward direction.

In yet another terminal, the elastic deformation part is connected to a base end of the substrate fixing part, a base end of each base part is connected to the elastic deformation part, and each contact arm extends downward from an intermediate position between a base end and a tip of the base part.

In yet another terminal, a base end of each base part is connected to the elastic deformation part, and a tip thereof is coupled to a tip of the other base part by a U-shaped coupling part.

In yet another terminal, each base part is coupled to a base end of the other base part by another U-shaped coupling part, and in a plan view, the counterpart terminal enters an opening having a periphery defined by the pair of base parts and the pair of coupling parts so as to mate with the terminal.

In yet another terminal, the substrate fixing part and the elastic deformation part are each provided as pairs thereof.

A connector including: a terminal which mates with a counterpart terminal; and a substrate having a surface to which the terminal is connected; wherein the terminal includes a substrate fixing part fixed to the substrate, a pair of contact parts which sandwich the counterpart terminal, and an elastic deformation part having both ends connected to the substrate fixing part and the contact parts, respectively, wherein a spring constant of the elastic deformation part is smaller than a spring constant of the contact parts.

Effects of the Invention

According to the present disclosure, it is possible to realize a connection with a counterpart connector with high spacing efficiency, and to stably maintain an electrically connected state while having a compact and low profile and without the terminal being deformed or damaged, even when subjected to a force from a counterpart terminal when mated with the counterpart terminal, which improves reliability.

BRIEF DESCRIPTION OF THE DRAWINGS

FIGS. 5A and 5B provide two views illustrating a state immediately before the connector and the counterpart connector are mated in the first embodiment, wherein FIG. 5A is a back view and FIG. 5B is a side view.

FIGS. 6A and 6B provide two views illustrating a state in which the connector and the counterpart connector are mated in the first embodiment, wherein FIG. 6A is a back view and FIG. 6B is a side view.

FIGS. 7A and 7B provide two views illustrating the operation in which the terminal absorbs the misalignment of the counterpart terminal in the first embodiment, wherein FIG. 7A is a drawing illustrating a first process in which the terminal and the counterpart terminal are mated, and FIG. 7B is a drawing illustrating a second process in which the terminal and the counterpart terminal are mated.

DETAILED DESCRIPTION OF THE PREFERRED EMBODIMENTS

Embodiments will hereinafter be described in detail with reference to the drawings.

Figure 1:
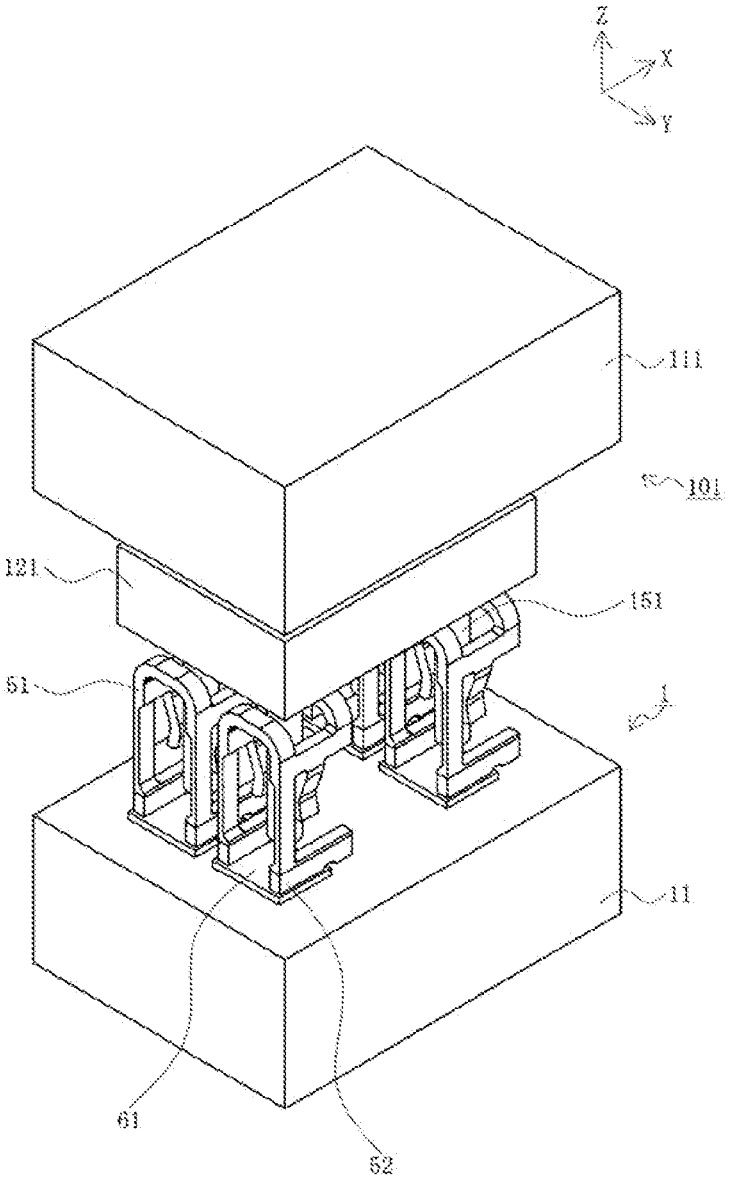
FIG. 1 is a perspective view illustrating a state in which a connector and a counterpart connector are mated in a first embodiment.
Figure 2:
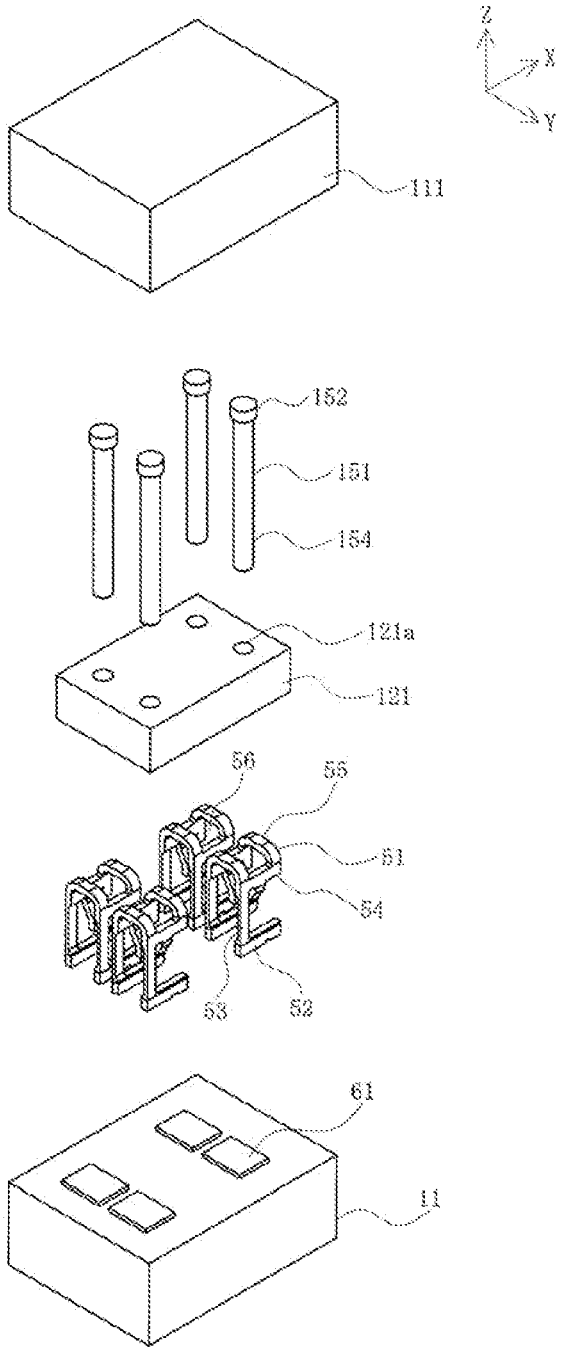
FIG. 2 is an exploded view of the connector and the counterpart connector in the first embodiment.
Figure 3A:
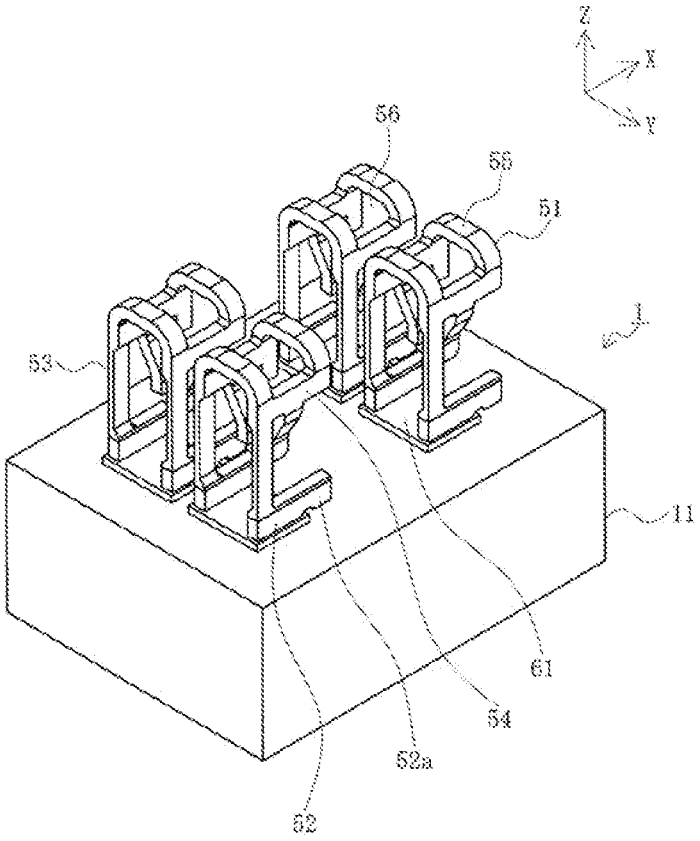
FIG. 3A is a perspective view of the connector in the first embodiment.
Figure 3B:
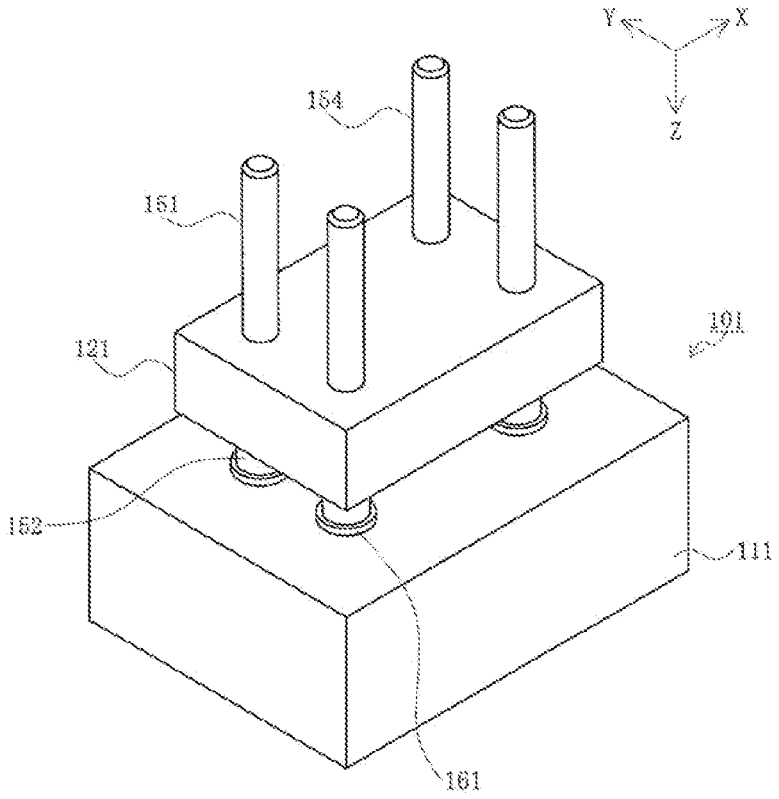
FIG. 3B is a perspective view of the counterpart connector in the first embodiment.
Figure 4A:
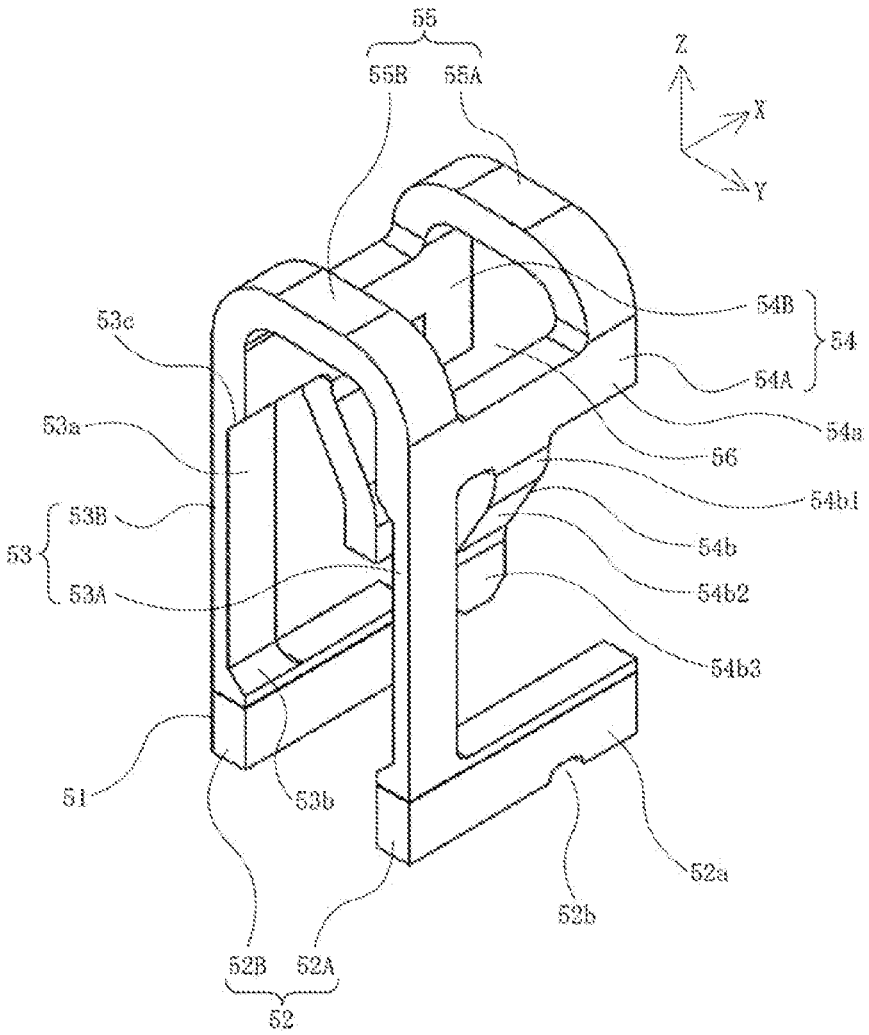
FIG. 4A is a perspective view of a terminal in the first embodiment.
Figure 4B:
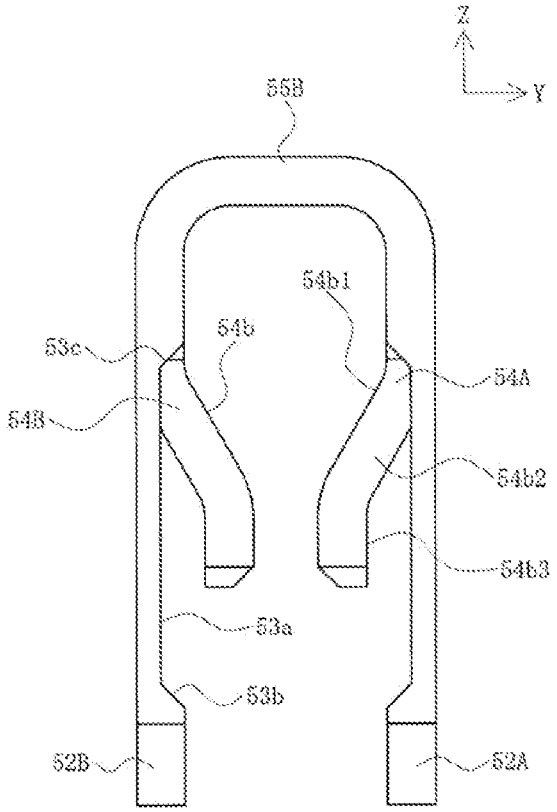
FIG. 4B is a back view of the terminal in the first embodiment.
Figure 4C:
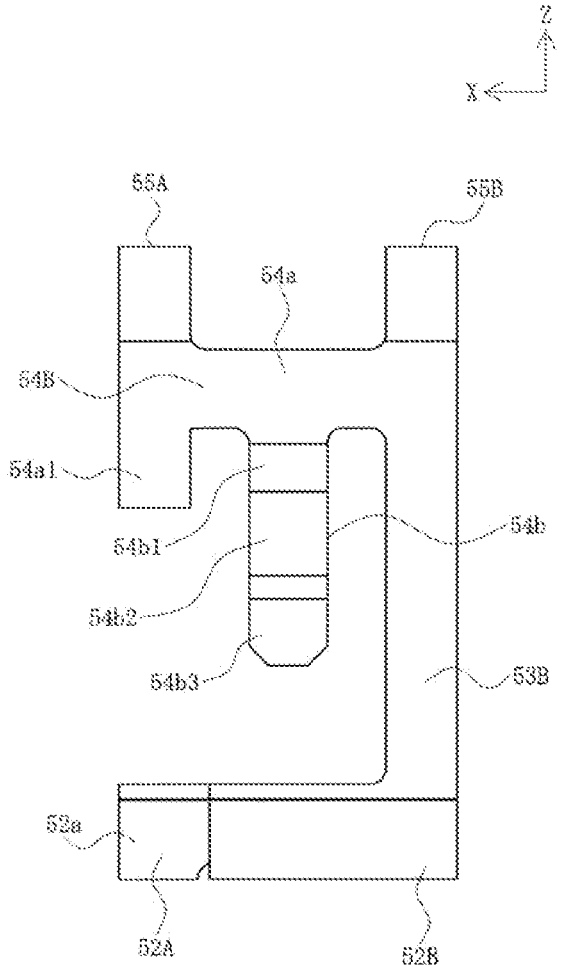
FIG. 4C is a side view of the terminal in the first embodiment.

FIG. 1 is a perspective view illustrating a state in which a connector and a counterpart connector are mated in a first embodiment. FIG. 2 is an exploded view of the connector and the counterpart connector in the first embodiment. FIG. 3A is a perspective view of the connector in the first embodiment. FIG. 3B is a perspective view of the counterpart connector in the first embodiment. FIG. 4A is a perspective view of a terminal in the first embodiment. FIG. 4B is a back view of the terminal in the first embodiment. FIG. 4C is a side view of the terminal in the first embodiment.

In the drawings, 1 is a connector according to the present embodiment, which is provided with a substrate 11 and a terminal 51 that is mechanically and electrically connected to the surface of the substrate 11, and is mated with a counterpart connector 101. In addition, the counterpart connector 101 includes a counterpart substrate 111 and a counterpart terminal 151 that is mechanically and electrically connected to the surface of the counterpart substrate 111.

The connector 1 according to the present embodiment is used, for example, to connect substrates such as printed wiring boards to one another or to connect an interposer for adjusting the pad spacing between a semiconductor device such as an LSI or a CPU and a substrate in a mobile communication device such as a smart phone or an electronic device such as a laptop computer, a tablet, a digital camera, a music player, a game machine, or a navigation device. Accordingly, the counterpart substrate 111 may be the same sort of substrate as the substrate 11 or may be an interposer, but here, a case in which it is the same sort of substrate as the substrate 11 will be described. Note that the substrate 11 and the counterpart substrate 111 may be, for example, a printed circuit board, a flexible flat cable (FFC), a flexible circuit board (FPC), or the like used in electronic devices or the like, but any type of board may be used as long as it is plate-like and has electrical circuits.

Moreover, expressions for indicating directions such as up, down, left, right, front, and back, used to describe the operations and configurations of the parts of the connector 1 and the counterpart connector 101 in the present embodiment are not absolute but rather relative directions, and though appropriate when the parts of the connector 1 and the counterpart connector 101 are at the positions illustrated in the figures, these directions should be interpreted differently when these positions change in correspondence with that change.

Further, the connector 1 includes only a substrate 11 and a terminal 51 connected to the surface of the substrate 11, and does not include a housing made of an insulating material such as a synthetic resin that is provided in a typical connector to house or hold the terminal 51. Note that in the example illustrated in the drawings, there are four terminals 51 arranged so as to be located at each vertex of a rectangle in a plan view (on the X-Y plane), but the number and arrangement of the terminals 51 are not limited thereto and can be optionally changed. In addition, the terminal 51 preferably has dimensions from around 0.3 to 1.0 [mm] in terms of vertical and horizontal height, but each dimension of the terminal 51 is not limited thereto and can be optionally changed. Further, rectangular connection pads 61 connected to an electrical circuit of the substrate 11 (not illustrated) are formed on the surface of the substrate 11. The shape, dimensions, number, and arrangement of the connection pads 61 are set to conform to the shape, dimensions, number, and arrangement of the terminals 51.

Each terminal 51 is preferably fabricated integrally by performing a process such as punching or bending on a conductive metal plate. Specifically, as illustrated in FIGS. 4A to 4C, the terminal has a pair of substrate fixing parts 52, a pair of elastic deformation parts 53 extending upward (Z-axis positive direction) from the substrate fixing parts 52, a pair of contact parts 54 connected to the upper ends of the elastic deformation parts 53, and a pair of coupling parts 55 for coupling the contact parts 54 to one another. In addition, in a plan view, the space having a periphery defined by the pair of contact parts 54 and the pair of coupling parts 55 is an opening 56 through which the counterpart terminal 151 enters. The terminal 51 has an overall shape such that it has plane symmetry using the X-Z plane passing through the center in the width direction (Y-axis direction) as a plane of symmetry.

Each of the pair of substrate fixing parts 52 is a prismatic portion extending in the longitudinal direction (X-axis direction) of the substrate 11, and they are arranged so as to be parallel to one another. Here, one of the substrate fixing parts 52 is referred to as a first substrate fixing part 52A, and the other substrate fixing part 52 is referred to as a second substrate fixing part 52B. Note that these are described as the substrate fixing part 52 when collectively referring to the first substrate fixing part 52A and the second substrate fixing part 52B.

In the example illustrated in the drawings, the first substrate fixing part 52A includes a tip extension 52*a* in front of a notch 52*b*, and the longitudinal dimension thereof is greater than that of the second substrate fixing part 52B by the amount of the tip extension 52*a*. Since the positions of the rear ends (right ends in FIG. 4C) of the first substrate fixing part 52A and the second substrate fixing part 52B are equal to one another, the tip—that is, the front end—of the first substrate fixing part 52A is positioned further forward (X-axis positive direction) than the front end of the second substrate fixing part 52B. As a result, in the production process, when the produced terminal 51 is cut and separated from a metal carrier made of a metal plate (not illustrated), the tip extension 52*a* can be gripped so as to easily cut the boundary between the tip of the tip extension 52*a* and the metal carrier, which enhances workability. Note that the tip extension 52*a* may also be omitted as necessary.

As illustrated in FIGS. 1 and 3A, the pair of substrate fixing parts 52 of each terminal 51 are mechanically and electrically connected to the surface of the connection pad 61 by soldering while the bottom surface thereof is facing the surface of the corresponding connection pad 61 on the surface of the substrate 11. Note that in the example illustrated in the drawings, the tip extension 52*a* of the first substrate fixing part 52A is not connected to the surface of the connection pad 61.

Each of the pair of elastic deformation parts 53 is a prismatic portion extending upward from the upper surface of the base end—that is, the rear end—of each substrate fixing part 52, and they are arranged so as to be parallel to one another. Here, the elastic deformation part 53 connected to the first substrate fixing part 52A is referred to as the first elastic deformation part 53A, and the elastic deformation part 53 connected to the second substrate fixing part 52B is referred to as the second elastic deformation part 53B. Note that these are described as the elastic deformation part 53 when collectively referring to the first elastic deformation part 53A and the second elastic deformation part 53B.

Each elastic deformation part 53 includes a recess 53*a* serving as a thin-walled part, a lower side inclined part 53*b* connected to the lower end of the recess 53*a*, and an upper side inclined part 53*c* connected to the upper end of the recess 53*a*. The recess 53*a* is a thin-walled portion having a small dimension in the thickness direction (Y-axis direction) fabricated by performing a process such as pressing, and is formed so that the plate thickness is smaller than that of the substrate fixing part 52, the contact part 54, and the coupling part 55. In the example illustrated in the drawings, the recess 53*a* is formed by recessing the inner surface of the elastic deformation part 53 (surface on the side where the pair of elastic deformation parts 53 face one another), and the outer surface of the elastic deformation part 53 is flat and flush with the outer surfaces of the substrate fixing part 52 and the contact part 54, but the recess 53*a* may also be formed on the outer surface of the elastic deformation part 53.

Since the recess 53*a* is formed over a range occupying most of each elastic deformation part 53, most portions of each elastic deformation part 53 have a smaller plate thickness than the substrate fixing part 52, the contact part 54, and the coupling part 55. Therefore, the elastic deformation part 53 is more flexible and more prone to elastic deformation than the substrate fixing part 52, the contact part 54, and the coupling part 55. In particular, when subjected to a force in the lateral direction (Y-axis direction) of the substrate 11, the section modulus of the elastic deformation part 53 is proportional to the square of the dimension in the thickness direction (Y-axis direction), and the geometrical moment of inertia is proportional to the cube of the dimension in the thickness direction, so the elastic deformation part 53 having a small dimension in the thickness direction tends to elastically deform in the direction in which the force is received.

In addition, the lower side inclined part 53*b* is a portion in which the lower end is connected to the substrate fixing part 52, and the plate thickness tapers upward from the dimension of the substrate fixing part 52 to the dimension of the recess 53*a*. Further, the upper side inclined part 53*c* is a portion in which the upper end is connected to the contact part 54, and the plate thickness tapers downward from the dimension of the contact part 54 to the dimension of the recess 53*a*.

Each of the pair of contact parts 54 includes a base part 54*a*, which is a prismatic member extending in the longitudinal direction of the substrate 11 parallel to one another and parallel to each substrate fixing part 52 and having a base end—that is, a rear end (right end in FIG. 4C)—connected to the upper end of each elastic deformation part 53—that is, the upper end of the upper side inclined part 53*c*—and a contact arm 54*b* extending downward from the lower surface of the base part 54*a*. Here, the contact part 54 connected to the first elastic deformation part 53A is referred to as the first contact part 54A, and the contact part 54 connected to the second elastic deformation part 53B is referred to as the second contact part 54B. Note that these are described as the contact part 54 when collectively referring to the first contact part 54A and the second contact part 54B.

In the example illustrated in the drawings, the second contact part 54B includes a downward convex part 54*a*1 extending downward from the lower surface at the tip—that is, the front end (left end in FIG. 4C)—of the base part 54*a*. The dimension of the downward convex part 54*a*1 in the vertical direction (Z-axis direction) is smaller than that of the contact arm 54*b*. Note that the downward convex part 54*a*1 may also be omitted as necessary.

Each contact arm 54*b* is connected to the lower surface of the base part 54*a* at an intermediate position between the front end and the rear end of the base part 54*a*. Each contact arm 54*b* includes a base end part 54*b*1 having an upper end connected to the lower surface of the base part 54*a*, an inclined part 54*b*2 which has an upper end connected to the lower end of the base end part 54*b*1 and is inclined so as to approach the other contact arm 54*b* in the downward direction, as is clearly illustrated in FIG. 4B, and a tip part 54*b*3 having an upper end connected to the lower end of the inclined part 54*b*2 and extending downward. Note that the plate thickness of each part of the contact arm 54*b* is uniform and is also the same as the plate thickness of the base part 54*a*. The contact arm 54*b* is a portion that comes into contact with a contact part 154 of the counterpart terminal 151, and the contact part 154 of the counterpart terminal 151 moves and advances relatively downward from above between the pair of contact arms 54*b*. Further, the spacing between the opposing tip parts 54*b*3 (spacing in the Y-axis direction) is set to be smaller than the outer dimension of the counterpart terminal 151 in the lateral direction (Y-axis direction) of the substrate 11, so the spacing between opposing tip parts 54*b*3 is elastically pushed out by the contact part 154 of the counterpart terminal 151. As a result, since the contact arms 54*b* exert a spring force, the contact part 154 of the counterpart terminal 151 is sandwiched by the contact arms 54*b* from both sides in the lateral direction of the substrate 11, which ensures reliable contact and communication with the contact arms 54*b*.

Note that the contact part 54 including the base part 54*a* and the contact arm 54*b* has the same dimension in the thickness direction as that of the substrate fixing part 52 and the coupling part 55, and is larger than the dimension in the thickness direction of the recess 53*a* of the elastic deformation part 53, so when subjected to a force in the lateral direction of the substrate 11, the sectional secondary modulus is greater than that of the elastic deformation part 53 so that it is less likely to deform than the elastic deformation part 53.

In addition, the elastic deformation part 53 extends upward from the rear end of the substrate fixing part 52, the base part 54*a* extends forward from the upper end of the elastic deformation part 53, and the contact arm 54*b* extends downward from the intermediate position between the front end and the rear end of the base part 54*a*, so the length of the path that follows the surface of the elastic deformation part 53, the base part 54*a*, and the contact arm 54*b* from the lower surface of the substrate fixing part 52 to reach the vicinity of the tip of the contact arm 54*b* increases. Accordingly, solder or flux is effectively prevented from following the aforementioned path from the lower surface of the substrate fixing part 52 and reaching the contact portion of the contact arm 54*b* and the contact part 154 of the counterpart terminal 151. As described above, no solder bumps or flux bumps are formed, so the conduction state between the contact arm 54*b* and the contact part 154 of the counterpart terminal 151 is favorably maintained.

Each of the pair of coupling parts 55 is curved to form a roughly inverted U-shape when the prismatic member is viewed in the longitudinal direction of the substrate 11—that is, on the Y-Z plane. These extend in the lateral direction (Y-axis direction) of the substrate 11 and are arranged parallel to one another in a plan view (on the X-Y plane), and the front ends and rear end of the base parts 54*a* of the pair of contact parts 54 are respectively coupled to one another. Here, the coupling part 55 that couples the front ends of the base parts 54*a* of the contact parts 54 is referred to as the first coupling part 55A, and the coupling part 55 that couples the rear ends of the base parts 54*a* of the contact parts 54 is referred to as the second coupling part 55B. Both ends of the first coupling part 55A are connected to the upper surface of the front end of the base part 54*a*, and both ends of the second coupling part 55B are connected to the upper surface of the rear end of the base part 54*a*. Note that these are described as the coupling part 55 when collectively referring to the first coupling part 55A and the second coupling part 55B.

As described above, the front ends and the rear ends of the base parts 54*a* of the pair of contact parts 54 are respectively coupled to one another by the coupling part 55, so when the contact part 154 of the counterpart terminal 151 enters the space between the pair of contact arms 54*b*, the spacing between the opposing base parts 54*a* is not pushed out even when subjected to a force which pushes the spacing between the pair of contact parts 54 out from the contact part 154 of the counterpart terminal 151. Accordingly, when the contact part 154 of the counterpart terminal 151 enters the space between the pair of contact arms 54*b*, primarily the long, narrow cantilevered contact arms 54*b* extending substantially in the vertical direction elastically deform so that the spacing between the opposing tip parts 54*b*3 is pushed out.

Note that when the contact part 154 of the counterpart terminal 151 enters the space between the pair of contact arms 54*b*, the pair of contact arms 54*b* are also subjected to a downward force from the contact part 154 of the counterpart terminal 151, so the contact arm 54*b* is connected to the base part 54*a* at an intermediate position between the front end and the rear end of the base part 54*a*, and only the rear end of the base part 54*a* is supported from below by the elastic deformation part 53, which causes a bending force to act on the elastic deformation part 53 so as to displace the upper end thereof forward. However, when subjected to a force in the longitudinal direction (X-axis direction) of the substrate 11, the elastic deformation part 53 has a larger dimension in the longitudinal direction (X-axis direction) than the dimension in the thickness direction (Y-axis direction), and the sectional secondary modulus of the elastic deformation part 53 in this case is proportional to the square of the dimension in the longitudinal direction, so the elastic deformation part 53 is less likely to bend in a manner that the upper end thereof is displaced forward. Note that as long as they are sufficient to support the pair of contact parts 54 coupled to one another by the coupling part 55, the elastic deformation part 53 and the substrate fixing part 52 do not necessarily need to be provided as pairs, and they may be provided as one side only.

In addition, the counterpart connector 101 further includes a terminal holding member 121 in addition to the counterpart substrate 111 and the counterpart terminal 151. Note that in the example illustrated in the drawings, there are four counterpart terminals 151 arranged so as to be located at each vertex of a rectangle in a plan view (on the X-Y plane), but the number and arrangement of the counterpart terminals 151 are not limited thereto and can be optionally changed so as to conform to the number and arrangement of the terminals 51 of the connector 1. Further, circular counterpart connection pads 161 connected to an electrical circuit of the counterpart substrate 111 (not illustrated) are formed on the surface of the counterpart substrate 111. The shape, dimensions, number, and arrangement of the counterpart connection pads 161 are set to conform to the shape, dimensions, number, and arrangement of the counterpart terminals 151.

The counterpart terminal 151 in the present embodiment is preferably fabricated integrally by performing a process such as machining, rolling, or cutting. Specifically, as illustrated in FIGS. 2 and 3B, the terminal has a substrate fixing part 152 and a contact part 154 extending downward (Z-axis negative direction) from the substrate fixing part 152.

In the example illustrated in the drawings, the substrate fixing part 152 is a thick disc-shaped member, the diameter of which is set to be smaller than the diameter of the counterpart connection pad 161. As illustrated in FIG. 3B, the substrate fixing part 152 is mechanically and electrically connected to the surface of the counterpart connection pad 161 by soldering while the bottom surface thereof (surface on the opposite side as the contact part 154) is facing the surface of the corresponding counterpart connection pad 161 on the surface of the counterpart substrate 111. In addition, the contact part 154 is a cylindrical member, the outside diameter of which is set to be smaller than the outside diameter of the substrate fixing part 152, smaller than the spacing between the pair of coupling parts 55 defining the periphery of the opening 56 of the terminal 51 of the connector 1 and the spacing between the base parts 54*a* of the pair of contact parts 54, and larger than the spacing between opposing tip parts 54*b*3.

The terminal holding member 121 is a member made of an insulating material such as a synthetic resin, and is a thick plate-like member with a rectangular planar shape having through-holes 121*a* formed so as to pass through the terminal holding member 121 in the plate thickness direction. The shape, dimensions, number, and arrangement of the through-holes 121*a* are set to conform to the shape, dimensions, number, and arrangement of the counterpart terminals 151. The contact part 154 of each counterpart terminal 151 is inserted into and held in the corresponding through-hole 121*a*. Note that the inside diameter of the through-hole 121*a* is preferably set to be slightly smaller than the diameter of the contact part 154. As a result, the contact part 154 is pressed into the through-hole 121*a* and is stably held.

Note that the cross-sectional shapes of the substrate fixing part 152, the contact part 154, and the through-hole 121*a* do not necessarily need to be circular, as in the example illustrated in the drawings, and may have a shape such as a square, hexagonal, or octagonal shape, but a case in which the cross-sectional shape is circular will be described here.

In addition, when assembling the counterpart connector 101, the contact part 154 of each counterpart terminal 151 is preferably first inserted into the corresponding through-hole 121*a* of the terminal holding member 121, and the tip of the contact part 154 is made to protrude from the through-hole 121*a* by a prescribed length. As a result, each counterpart terminal 151 is held by the terminal holding member 121 in a state in which the bottom surfaces of the substrate fixing parts 152 are substantially flush with one another and in a state in which the arrangement thereof is similar to that of the counterpart connection pads 161. The bottom surfaces of the substrate fixing parts 152 of a plurality of counterpart terminals 151 held by the terminal holding member 121 are then connected by welding while facing the counterpart connection pads 161 of the counterpart substrate 111. As a result, the counterpart connector 101 can be assembled easily in a short amount of time.

Next, the operation of mating the connector 1 and the counterpart connector 101 with the above configuration will be described.

Figure 5B:
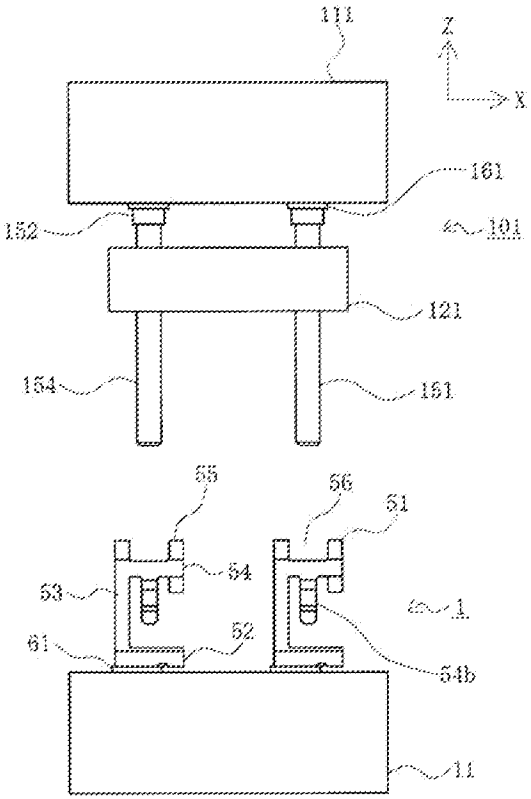
Figure 5A:
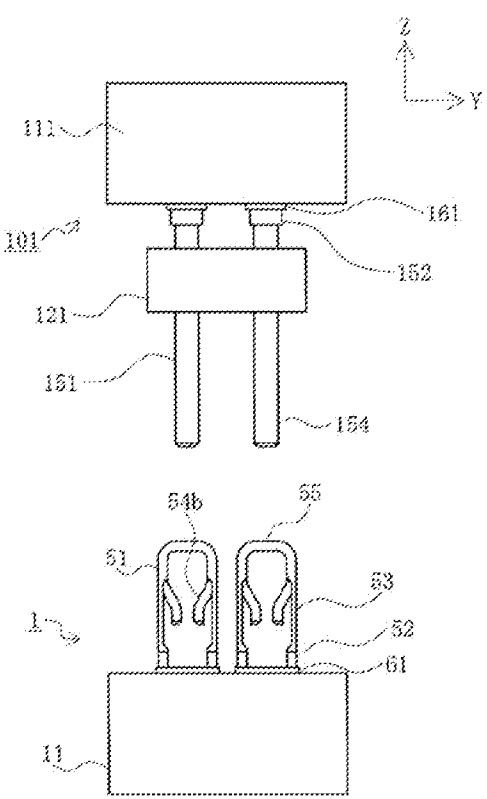
Figure 6B:
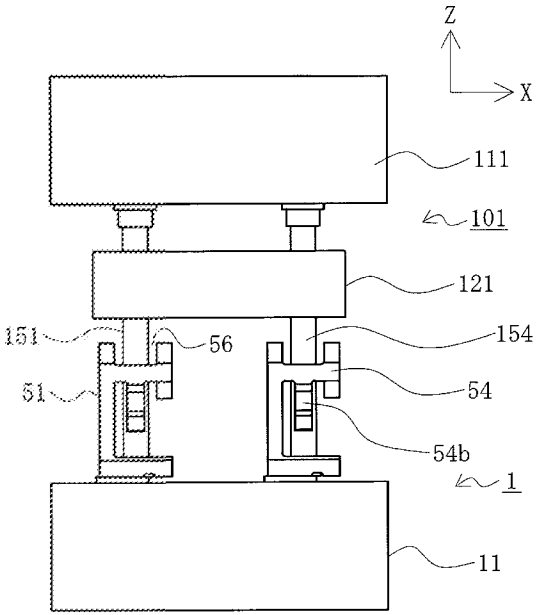
Figure 6A:
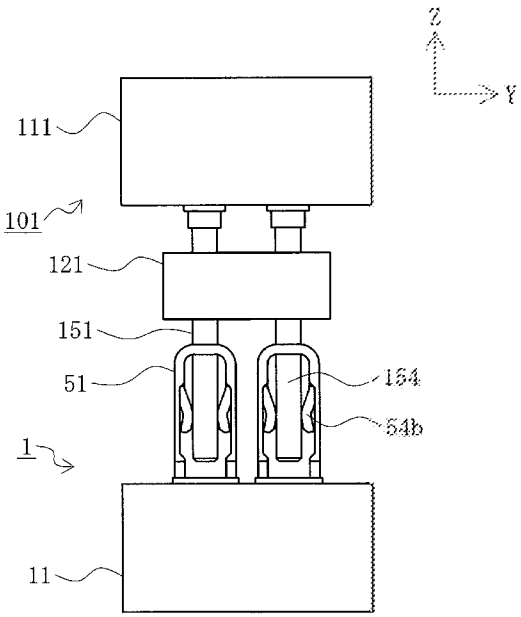
Figure 7A:
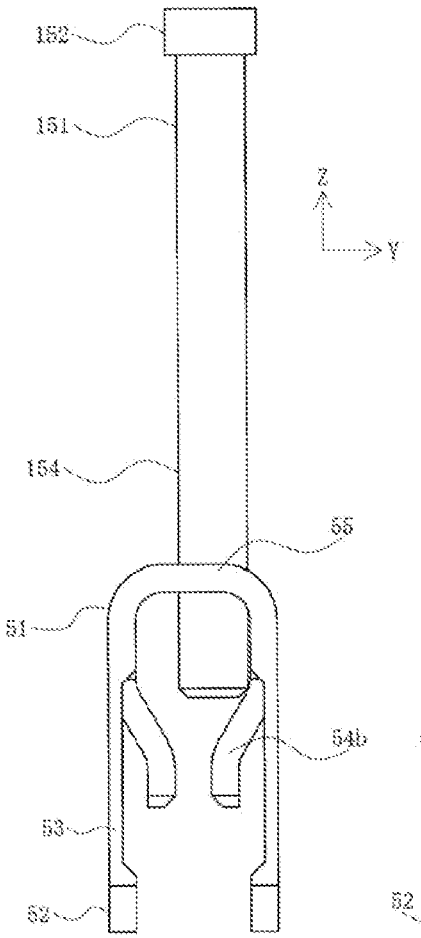
Figure 7B:
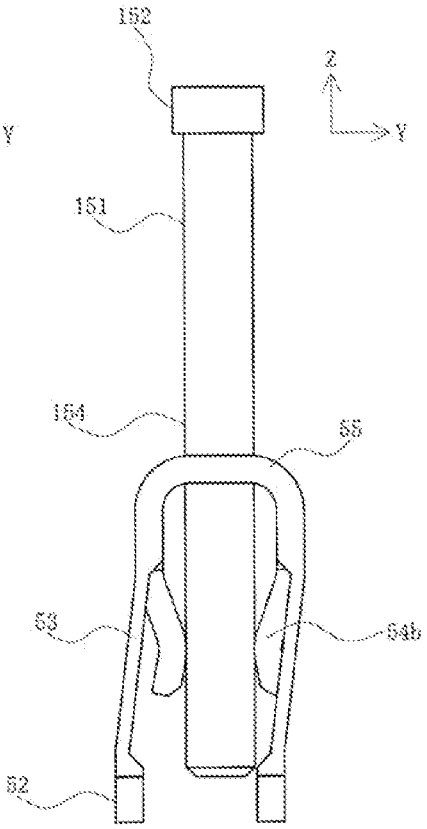

FIGS. 5A and 5B provide two views illustrating a state immediately before the connector and the counterpart connector are mated in the first embodiment. FIGS. 6A and 6B provide two views illustrating a state in which the connector and the counterpart connector are mated in the first embodiment. FIGS. 7A and 7B provide two views illustrating the operation in which the terminal absorbs the misalignment of the counterpart terminal in the first embodiment. Note that in FIGS. 5A, 5B, 6A and 6B, FIGS. 5A and 6A are back views and FIGS. 5B and 6B are side views. In FIGS. 7A and 7B, FIG. 7A is a drawing illustrating a first process in which the terminal and the counterpart terminal are mated, and FIG. 7B is a drawing illustrating a second process in which the terminal and the counterpart terminal are mated.

First, as illustrated in FIGS. 5A and 5B, the operator makes the surface of the substrate 11 of the connector 1 face the surface of the counterpart substrate 111 of the counterpart connector 101. When the position of the center of the opening 56 of each terminal 51 is aligned with the position of the center of the contact part 154 of the corresponding counterpart terminal 151 in the X-Y plane, the connector 1 and the counterpart connector 101 assume the normal position with respect to one another, and the alignment of the connector 1 and the counterpart connector 101 is complete.

When the connector 1 and/or the counterpart connector 101 are moved in a direction approaching the side of the other—that is, in the mating direction—while maintaining such a normal position, the contact part 154 of the counterpart terminal 151 of the counterpart connector 101 enters the opening 56 of the terminal 51 of the connector 1 and further enters the space between the pair of contact arms 54*b* of the terminal 51. In the pair of contact arms 54*b*, the spacing between the base end parts 54*b*1 is greater than the outside dimension of the contact part 154 of the counterpart terminal 151, but the spacing between the inclined parts 54*b*2 tapers downward, so the contact part 154 of the counterpart terminal 151 comes into contact with the inclined parts 54*b*2 at an intermediate position. Further, in the mutually facing surfaces of the pair of contact arms 54*b*, the connection portions between the inclined parts 54*b*2 and the tip parts 54*b*3 are curved, so when the contact part 154 of the counterpart terminal 151 advances further, the spacing between the contact arms 54*b* is pushed out smoothly. In addition, primarily the long, narrow cantilevered contact arms 54*b* elastically deform so that the spacing between the opposing tip parts 54*b*3 is pushed out, and the contact arms 54*b* are pushed to both sides of the contact part 154 of the counterpart terminal 151 by their own spring force. As a result, when the mating of the connector 1 and the counterpart connector 101 is completed, as illustrated in FIGS. 1, 6A and 6B, each terminal 51 and each counterpart terminal 151 are in a conductive state.

That is, as illustrated in FIGS. 6A and 6B, the contact part 154 of each counterpart terminal 151 enters the space between the pair of contact arms 54*b* of each terminal 51 so that the force from the contact part 154 of the counterpart terminal 151 is received and the spacing between the pair of contact parts 54 is elastically pushed out. As a result, since the contact arms 54*b* exert a spring force, the contact part 154 of the counterpart terminal 151 is sandwiched by the contact arms 54*b* from both sides in the lateral direction of the substrate 11, which ensures reliable contact and communication with the contact arms 54*b*. Therefore, even when subjected to shock or vibration, the conductive state between each terminal 51 and each counterpart terminal 151 can be maintained. A conductive trace coupled to the connection pad 61 on the substrate 11 to which the substrate fixing part 52 of each terminal 51 is connected and a conductive trace coupled to the counterpart connection pad 161 on the counterpart substrate 111 to which the substrate fixing part 152 of the counterpart terminal 151 is connected are then conductive with one another.

Incidentally, the positions of the centers of the openings 56 of several terminals 51 may deviate from the positions of the centers of the contact parts 154 of the corresponding counterpart terminals 151 due to some causes such as reduced dimensional precision or increased assembly tolerance of each part of the connector 1 and/or the counterpart connector 101, or reduced operating precision for mating the connector 1 and the counterpart connector 101. That is, relative misalignment may occur in the counterpart terminals 151 with respect to the terminals 51. However, even in such cases, the terminal 51 has the elastic deformation part 53 and is therefore able to absorb the misalignment of the counterpart terminal 151.

For example, when misalignment occurs in a counterpart terminal 151 in the lateral direction (Y-axis direction) of the substrate 11 with respect to a terminal 51, as illustrated in FIG. 7A, the contact part 154 of the counterpart terminal 151 deviates from the center of the opening 56 in the lateral direction (Y-axis positive direction in the example illustrated in FIG. 7A) of the substrate 11 when entering the opening 56 of the terminal 51. When the contact part 154 of the counterpart terminal 151 enters the space between the pair of contact arms 54*b* of the terminal 51 in this state, as illustrated in FIG. 7B, the elastic deformation part 53 deforms, and the contact part 54 and the coupling part 55 connected to the upper end of the elastic deformation part 53 are offset in the lateral direction of the substrate 11 in the same manner as the contact part 154 of the counterpart terminal 151, thereby completing the mating process. The spacing between the pair of contact parts 54 is then elastically pushed out under the force from the contact part 154 of the counterpart terminal 151 in the same manner as when the position of the center of the opening 56 of the terminal 51 and the position of the center of the contact part 154 of the counterpart terminal 151 are aligned as illustrated in FIGS. 6A and 6B. As a result, since the contact arms 54*b* exert a spring force, the contact part 154 of the counterpart terminal 151 is sandwiched by the contact arms 54*b* from both sides in the lateral direction of the substrate 11, which ensures reliable contact and communication with the contact arms 54*b*. Therefore, even when subjected to shock or vibration, the conductive state between each terminal 51 and each counterpart terminal 151 can be maintained.

That is, when misalignment occurs between the terminal 51 and the counterpart terminal 151, the elastic deformation part 53, which is softer and more prone to elastic deformation—that is, it has a lower spring constant—than the contact part 54 primarily deforms so as to absorb the misalignment. Therefore, the terminal 51 and the counterpart terminal 151 are not plastically deformed or damaged, and the connection between the terminal 51 and the connection pad 61 and the connection between the counterpart terminal 151 and the counterpart connection pad 161 are not broken. In addition, the contact part 54 is relatively resistant to elastic deformation—that is, it has a high spring constant—so when the contact part 154 of the counterpart terminal 151 enters the space between the pair of contact parts 54 and the spacing between the pair of contact parts 54 is pushed out, the contact arms 54*b* exert a strong spring force, which makes it possible to strongly sandwich the contact part 154 and to ensure the contact between the contact arms 54*b* and the contact part 154. Therefore, even when subjected to shock or vibration, the conductive state between each terminal 51 and each counterpart terminal 151 can be maintained.

In this way, in the connector 1 according to the present embodiment, the terminal 51 has a pair of elastic deformation parts 53, and each of the pair of contact parts 54 is connected to each of the elastic deformation parts 53, so the pair of contact parts 54 can be offset in the direction in which the elastic deformation parts 53 elastically deform. Therefore, it is unnecessary to restrict the range of misalignment of the counterpart terminal 151 using a housing made of a resin or the like separate from the terminal 51, and even if misalignment occurs during mating, the positional relationship between the contact parts 54 does not change, so the pair of contact arms 54*b* can sandwich the counterpart terminal 151 with equal contact pressure, which makes it possible to achieve a stable contact state between the terminal 51 and the counterpart terminal 151. Moreover, since the terminal 51 can absorb misalignment with a simple configuration, the terminal 51 and the counterpart terminal 151 are not plastically deformed or damaged, and the connection between the terminal 51 and the connection pad 61 and the connection between the counterpart terminal 151 and the counterpart connection pad 161 are not broken, so the substrate 11 and the counterpart substrate 111 can be stably connected. Further, even when subjected to an external force or shock, the pair of elastic deformation parts 53 elastically deform and absorb the force or shock, so the force or shock is not transmitted to the substrate fixing part 52. Therefore, the connection between the terminal 51 and the connection pad 61 is not broken due to so-called solder peeling, and the conductive state between the terminal 51 and the substrate 11 is stable.

In addition, each of the pair of contact parts 54 includes a base part 54*a* connected to the upper end of each elastic deformation part 53, and a contact arm 54*b* extending downward from the lower surface of the base part 54*a*. Each contact arm 54*b* includes a base end part 54*b*1 having an upper end connected to the lower surface of the base part 54*a*, an inclined part 54*b*2 which has an upper end connected to the lower end of the base end part 54*b*1 and is inclined so as to approach the other contact arm 54*b* in the downward direction, and a tip part 54*b*3 having an upper end connected to the lower end of the inclined part 54*b*2 and extending downward. The spacing between the opposing contact arms 54*b* (distance in the Y-axis direction) tapers downward, becoming smaller than the outer dimension of the contact part 154 of the counterpart terminal 151, and is minimized at the tip part 54*b*3. Therefore, even without using a housing made of a resin or the like separate from the terminal 51 to narrow the opening portion into which the counterpart terminal 151 relatively enters so as to align the counterpart terminal 151 with the terminal 51, the contact part 154 of the counterpart terminal 151 is smoothly guided between the pair of contact arms 54*b* along the inclination of the inclined part 54*b*2, so the terminal 51 and the counterpart terminal 151 are not plastically deformed or damaged. Moreover, the contact arm 54*b* can be disposed at a position that does not overlap with the elastic deformation part 53. In the example illustrated in the drawings, the contact arm 54*b* is positioned in front of the elastic deformation part 53 (X-axis positive direction). As a result, even if the elastic deformation part 53 deforms in the plate thickness direction thereof (Y-axis direction), it does not interfere with the contact arm 54*b* and can elastically deform smoothly.

In addition, the coupling part 55 that couples the pair of contact parts 54 to one another can be disposed at a position that also does not overlap with the contact arm 54*b* disposed at a position that does not overlap with the elastic deformation part 53. In the example illustrated in the drawings, the first coupling part 55A is disposed further forward than the contact arm 54*b* positioned in front of the elastic deformation part 53. As a result, the base parts 54*a* are coupled to one another at a position separated from the elastic deformation part 53, so the positional relationship between the contact parts 54 is unlikely to change, and the contact arms 54*b* can sandwich the contact part 154 of the counterpart terminal 151 with equal contact pressure, which makes it possible to achieve a stable contact state between the terminal 51 and the counterpart terminal 151.

In addition, the coupling part 55 can be disposed at a position that overlaps with the elastic deformation part 53. In the example illustrated in the drawings, the second coupling part 55B is connected to the upper surface of the rear end of the base part 54*a* having a lower surface to which the elastic deformation part 53 is connected. As a result, the upper ends of the pair of elastic deformation parts 53 are substantially coupled by the coupling part 55, so one of the elastic deformation parts 53 easily deforms in accordance with the deformation of the other elastic deformation part 53, and a stable contact state can be achieved between the terminal 51 and the counterpart terminal 151.

In addition, the dimension of the contact arm 54*b* in the thickness direction (Y-axis direction) that is, the plate thickness—can be made greater than that of the elastic deformation part 53. As a result, when there is misalignment between the terminal 51 and the counterpart terminal 151 during mating, the contact arm 54*b* is elastically deformed as it is pressed by the contact part 154 of the counterpart terminal 151 so that the elastic deformation part 53 elastically deforms and absorbs the misalignment before the contact arm exerts sufficient contact pressure to come into contact with the contact part 154 of the counterpart terminal 151, so electrical conduction can be begun in a stable state.

In addition, in each elastic deformation part 53, a lower side inclined part 53*b* having a plate thickness that tapers upward can be formed at the lower end of the recess 53*a* having a smaller plate thickness than other portions of the terminal 51. As a result, locations that may serve as a fulcrum of the deformation of the elastic deformation part 53 are reinforced, which makes it possible to suppress the occurrence of plastic deformation due to excessive deformation. Further, by forming an upper side inclined part 53*c* having a plate thickness that tapers downward at the upper end of the recess 53*a*, the vicinity of the upper end of the elastic deformation part 53 can be reinforced so that it does not plastically deform due to the force received from the contact part 54.

In this way, the terminal 51 according to the present embodiment includes a substrate fixing part 52 fixed to the substrate 11, a pair of contact parts 54 which sandwich the counterpart terminal 151, and an elastic deformation part 53 having both ends connected to the substrate fixing part 52 and the contact parts 54, respectively, wherein the spring constant of the elastic deformation part 53 is smaller than a spring constant of the contact parts 54. In addition, the connector 1 according to the present embodiment includes a terminal 51 that mates with a counterpart terminal 151 and a substrate 11 having a surface to which the terminal 51 is connected. The terminal 51 then includes a substrate fixing part 52 fixed to the substrate 11, a pair of contact parts 54 which sandwich the counterpart terminal 151, and an elastic deformation part 53 having both ends connected to the substrate fixing part 52 and the contact parts 54, respectively, wherein the spring constant of the elastic deformation part 53 is smaller than a spring constant of the contact parts 54.

As a result, it is possible to realize a connection with a counterpart connector 101 with high spacing efficiency, and to stably maintain an electrically connected state while having a compact and low profile and without the terminal 51 being deformed or damaged, even when subjected to a force from a counterpart terminal 151 when mated with the counterpart terminal 151, which improves reliability. Moreover, the connection between the terminal 51 and the connection pad 61 is not broken due to so-called solder peeling, and the conductive state between the terminal 51 and the substrate 11 is stable. Further, the connection between the counterpart terminal 151 and the counterpart connection pad 161 is not broken.

In addition, the elastic deformation part 53 includes a recess 53*a* having a smaller plate thickness than the substrate fixing part 52 and the contact part 54. Further, each contact part 54 further includes a base part 54*a* connected to the upper end of the elastic deformation part 53 and extending parallel to the substrate fixing part 52, and a contact arm 54*b* extending downward from the bottom surface of the base part 54*a*, wherein each contact arm 54*b* includes an inclined part 54*b*2 which is inclined so as to approach the other contact arm 54*b* in the downward direction. Further, each elastic deformation part 53 is connected to the base end of the substrate fixing part 52, the base end of each base part 54*a* is connected to the elastic deformation part 53, and each contact arm 54*b* extends downward from an intermediate position between the base end and the tip of the base part 54*a*. Further, the base end of each base part 54*a* is connected to the elastic deformation part 53, and the tip thereof is coupled to the tip of the other base part 54*a* by a U-shaped coupling part 55. Further, each base part 54*a* is coupled to the base end of the other base part 54*a* by another U-shaped coupling part 55, and in a plan view, the counterpart terminal 151 enters an opening 56 having a periphery defined by the pair of base parts 54*a* and the pair of coupling parts 55 so as to mate with the terminal 51. Further, the connection between the terminal 51 and the connection pad 61 and the connection between the counterpart terminal 151 and the counterpart connection pad 161 are not broken.

Next, a second embodiment will be described. Note that, for portions having the same structure as that of the first embodiment, descriptions thereof are omitted by giving the same reference numerals thereto. Moreover, descriptions of the same operations and effects as those of the first embodiment will be omitted.

Figure 8:
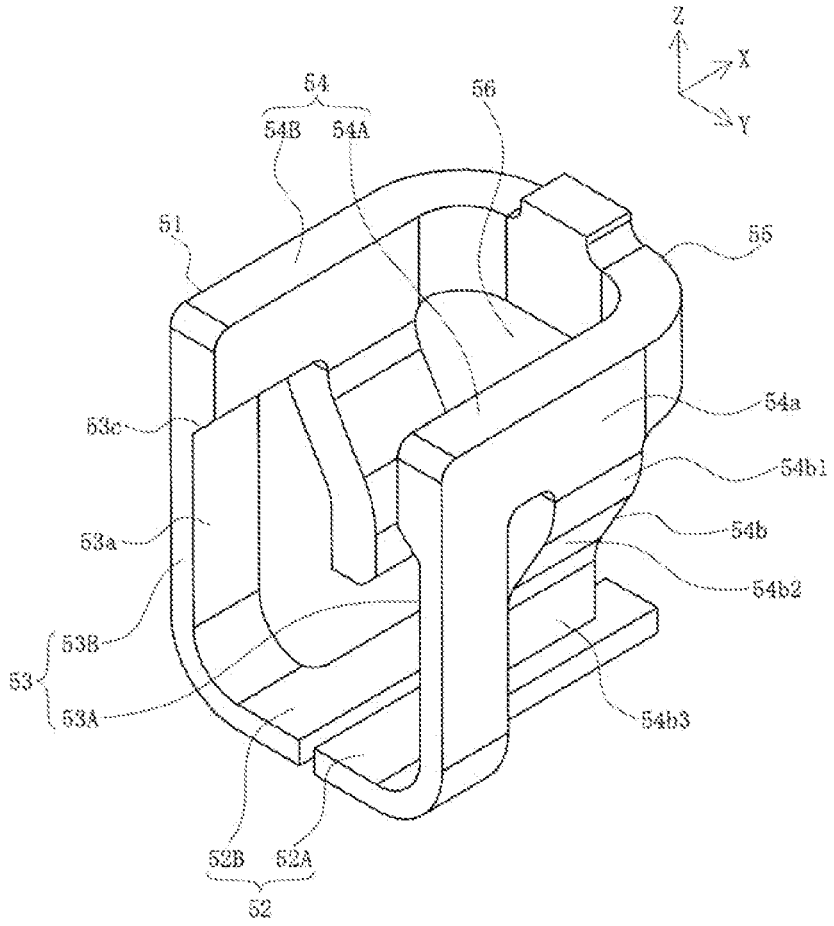
FIG. 8 is a perspective view of a terminal in a second embodiment.
Figure 9:
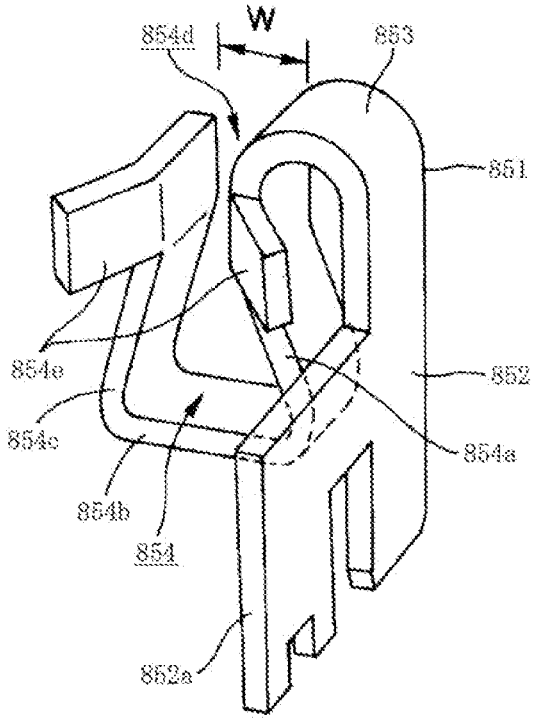
FIG. 9 is a perspective view illustrating a terminal of a conventional connector.

FIG. 8 is a perspective view of a terminal in the second embodiment.

In the present embodiment, as illustrated in FIG. 8, a terminal 51 includes a pair of substrate fixing parts 52, a pair of elastic deformation parts 53, a pair of contact parts 54, and a coupling part 55 that couples the contact parts 54 to one another. The terminal 51 has an overall shape such that it has plane symmetry using the X-Z plane passing through the center in the width direction (Y-axis direction) as a plane of symmetry.

The contact part 54 in the present embodiment is the same as in the first embodiment.

In the substrate fixing part 52 according to the present embodiment, the spacing between the first substrate fixing part 52A and the second substrate fixing part 52B is narrower than the spacing between the first substrate fixing part 52A and the second substrate fixing part 52B in the first embodiment. In addition, the substrate fixing part 52 according to the first embodiment has a rectangular prismatic cross-sectional shape with a dimension in the vertical direction (Z-axis direction) that is longer than in the horizontal direction (Y-axis direction), while the dimension in the horizontal direction—that is, the thickness direction—is greater than that of the recess 53*a* of the elastic deformation part 53, whereas the substrate fixing part 52 according to the present embodiment has a rectangular planar cross-sectional shape with a dimension in the vertical direction that is shorter than in the horizontal direction, while the dimension in the vertical direction—that is, the thickness direction—is the same as that of the recess 53*a* of the elastic deformation part 53.

The elastic deformation part 53 according to the first embodiment is a portion extending linearly in the vertical direction, and the lower side inclined part 53*b* connected to the lower end of the recess 53*a* is connected to the upper surface of the substrate fixing part 52. In contrast, the elastic deformation part 53 according to the present embodiment does not include a lower side inclined part 53*b*, and the vicinity of the lower end of the recess 53*a* has a substantially curved J-shape when viewed in the forward-backward direction (X-axis direction) that is—on the Y-Z plane—with the lower end being connected to the side surface of the substrate fixing part 52.

The coupling parts 55 in the first embodiment are provided as a pair, each of which respectively couples the front ends and the rear ends of the base parts 54*a* of the contact parts 54, whereas the coupling part 55 in the present embodiment is a single coupling part which couples only the front ends of the base parts 54*a* of the contact parts 54. In addition, the coupling part 55 in the first embodiment is curved to form a shape with a roughly inverted U-shape when viewed in the front-back direction—that is, on the Y-Z plane—with both ends thereof being connected to the upper surfaces at the front end and the rear end of the base part 54*a* of the contact part 54, whereas the coupling part 55 in the present embodiment is curved to roughly form a U-shape in a plan view—that is, on the X-Y plane—with both ends thereof being connected to the front end surface of the base part 54*a* of the contact part 54.

The four sides of the periphery of the opening 56 in the first embodiment are defined by the pair of contact parts 54 and the pair of coupling parts 55 in a plan view, whereas only three of the four sides of the periphery of the opening 56 in the present embodiment are defined by the pair of contact parts 54 and the single coupling part 55, while one side is left open.

Note that the configuration, operation, and effects of the other points of the terminal 51 and the connector 1 according to the present embodiment are the same as those of the first embodiment, so descriptions thereof will be omitted.

Moreover, the disclosure herein describes features relating to suitable exemplary embodiments. Various other embodiments, modifications, and variations within the scope and spirit of Scope of the Patent Claims appended hereto will naturally be conceived of by those skilled in the art upon review of the disclosure herein.

INDUSTRIAL APPLICABILITY

The present disclosure can be applied to a terminal and a connector.

The invention claimed is:

1. A terminal comprising:

(a) first and second substrate fixing parts fixed to a substrate;

(b) first and second contact parts which sandwich a counterpart terminal; and (c) first and second elastic deformation parts, the first elastic deformation part having a lower end connected to the first substrate fixing part and an upper end connected to the first contact part, and the second elastic deformation part having a lower end connected to the second substrate fixing part and an upper end connected to the second contact part; and wherein a spring constant of the elastic deformation parts is smaller than a spring constant of the contact parts, wherein the first contact part further includes a first base part connected to the upper end of the first elastic deformation part and extending parallel to the first substrate fixing part, and a first contact arm extending downward from a bottom surface of the base part, and the first contact arm includes a first inclined part, wherein the second contact part further includes a second base part connected to the upper end of the second elastic deformation part and extending parallel to the second substrate fixing part, and a second contact arm extending downward from a bottom surface of the second base part, and the second contact arm includes a second inclined part, and wherein the first inclined part is inclined so as to approach the second contact arm in a downward direction and the second inclined part is inclined so as to approach the first contact arm in the downward direction.

2. The terminal according to claim 1, wherein the first elastic deformation part includes a thin part having a smaller plate thickness than the first substrate fixing part and the first contact part, and the second elastic deformation part includes a thin part having a smaller plate thickness than the second substrate fixing part and the second contact part.

3. The terminal according to claim 1, wherein the fist elastic deformation part is connected to a base end of the first substrate fixing part, a base end of the first base part is connected to the first elastic deformation part, and the first contact arm extends downward from an intermediate position between the base end of the first base part and a tip of the first base part, and wherein the second elastic deformation part is connected to a base end of the second substrate fixing part, a base end of the second base part is connected to the second elastic deformation part, and the second contact arm extends downward from an intermediate position between the base end of the second base part and a tip of the second base part.

4. The terminal according to claim 1, wherein a base end of the first base part is connected to the first elastic deformation part, and a base end of the second base part is connected to the second elastic deformation part, and tips of the first and second base parts are coupled by a U-shaped coupling part.

5. The terminal according to claim 4, wherein the base ends of the base parts are coupled by another U-shaped coupling part, and in a plan view, the counterpart terminal enters an opening having a periphery defined by the first and second base parts and the first and second coupling parts so as to mate with the terminal.

* * * * *